United States Patent [19]

Lusk

[11] 4,156,981

[45] Jun. 5, 1979

[54] REVOLVER-TYPE REPEATING GUN

[75] Inventor: Norman E. Lusk, Seeleys Bay, Canada

[73] Assignee: Her Majesty the Queen in right of Canada, Canada

[21] Appl. No.: 831,966

[22] Filed: Sep. 9, 1977

[30] Foreign Application Priority Data

Oct. 20, 1976 [CA] Canada ..... 263776

[51] Int. Cl.[2] ..... F41C 1/02

[52] U.S. Cl. ..... 42/63; 42/1 F; 42/59

[58] Field of Search ..... 42/1 F, 59, 63, 64, 42/67

[56] References Cited

U.S. PATENT DOCUMENTS

| | | | |
|---|---|---|---|
| 1,787,939 | 1/1931 | Ellis | 42/59 |
| 1,844,779 | 2/1932 | Messenie | 42/59 |
| 1,898,237 | 2/1933 | Bocco | 42/59 |
| 2,395,354 | 2/1946 | Temple | 42/59 |
| 3,435,549 | 4/1969 | Kermode | 42/1 F |
| 3,444,778 | 5/1969 | Bates | 42/1 F |
| 3,545,117 | 12/1970 | VanVoorhees | 42/59 |
| 3,566,527 | 3/1971 | Silsby | 42/1 F |
| 3,765,116 | 10/1973 | Zaid | 42/59 |
| 3,797,153 | 3/1974 | Hagan | 42/59 |

*Primary Examiner*—Charles T. Jordan

*Attorney, Agent, or Firm*—Stevens, Davis, Miller & Mosher

[57] ABSTRACT

The invention disclosed is a man-portable multi-shot weapon capable of firing relatively large caliber projectiles e.g. 38–40mm at a rapid rate and to the conversion of a similar existing single-shot weapon to multi-shot capability. The multi-shot weapon comprises a barrel, a breech frame on which the barrel is mounted, said breech frame defining a lateral opening through opposite sides of the frame for receiving a magazine having a plurality of chambers to accomodate relatively large caliber projectiles, said magazine being rotatably mounted in said opening in such a manner that the chambers may be successively brought into a firing position in alignment with the barrel, and firing means for firing a projectile when in the firing position.

9 Claims, 8 Drawing Figures

REVOLVER-TYPE REPEATING GUN

BACKGROUND OF THE INVENTION

This invention relates to a man-portable multi-shot weapon capable of firing relatively large calibre projectiles at a rapid rate and to a conversion unit for use in providing single-shot weapons with multi-shot capability.

At present, the only large calibre man-portable weapons are single-shot, breech loading types such as the American 40mm M70 grenade launcher and the 38mm Federal gas gun. These weapons have relatively slow rates of fire which is a drawback due to the short range of the weapon. This means that a moving target can cover the engagement distance or retreat out of range in a relatively short period of time. Single-shot, breech loading weapons also have disadvantages insofar as the "zeroing-in" aspect is concerned. In other words, by observation of the point of impact of a shot, one can make corrections to the line of sight so as to bring the next shot on target. More specifically, the weapon must be taken from the shoulder to reload between each shot, thus taking the eve of the user off the target. Secondly, the re-loading time is considerably longer. These two aspects combine to reduce the ability to effectively use the information gained from the observation of the point of impact of one shot for zeroing in the succeeding shots.

SUMMARY OF THE INVENTION

Thus, a rapid rate of fire would considerably increase the effectiveness of the weapon, especially when dealing with highly mobile targets. A rapid rate of fire combined with the ability to fire a number of rounds without removing the line of sight from the target greatly improves the effectiveness of the correction mentioned above, thereby considerably improving the hit probability of succeeding rounds. This is especially true when engaging moving targets where an estimation of lead is required. Moreover, when employing gas, smoke, or illuminating munitions, rapid fire capability would enable the production in minimum time of the intensity of gas, smoke or light required in a particular situation.

Accordingly, it is an object of the invention to provide a man-portable multi-shot weapon capable of firing relatively large calibre projectiles at a rapid rate.

It is another object of the invention to provide a conversion unit for providing relatively large calibre single-shot weapons with multi-shot capability.

According to one aspect of the invention, a man-portable multi-shot weapon capable of firing relatively large calibre projectiles at a rapid rate is provided, comprising a barrel, a breech frame on which the barrel is mounted, siad breech frame defining a lateral opening through opposite sides of the frame for receiving a magazine having a plurality of chambers to accomodate relatively large calibre projectiles, said magazine being rotatably mounted in said opening in such a manner that the chambers may be successively brought into a firing position in alignment with the barrel, and firing means for firing a projectile when in the firing position.

According to another aspect of the invention, a conversion unit for use in converting a single-shot weapon, capable of firing relatively large calibre projectile, to multi-shot capability is contemplated, wherein said single-shot weapon comprises a barrel to be removed and discarded and a stock and firing means to be modified for use with said conversion unit, said conversion unit comprising a barrel, a breech frame on which the barrel is mounted, and means for connecting the conversion unit to said stock and firing means, said breech frame when connected to said modified stock and firing means defining a lateral opening through opposite sides of the frame for receiving a magazine having a plurality of chambers to accommodate relatively large calibre projectiles, said magazine being rotatably mounted in said opening being adapted to be rotatably advanced in such a manner that the chambers are successively brought into a firing position in alignment with the barrel.

BRIEF DESCRIPTION OF THE DRAWINGS

In the drawings which serve to illustrate a preferred embodiment of the invention.

DESCRIPTION OF THE PREFERRED EMBODIMENT(S)

Figure 1:
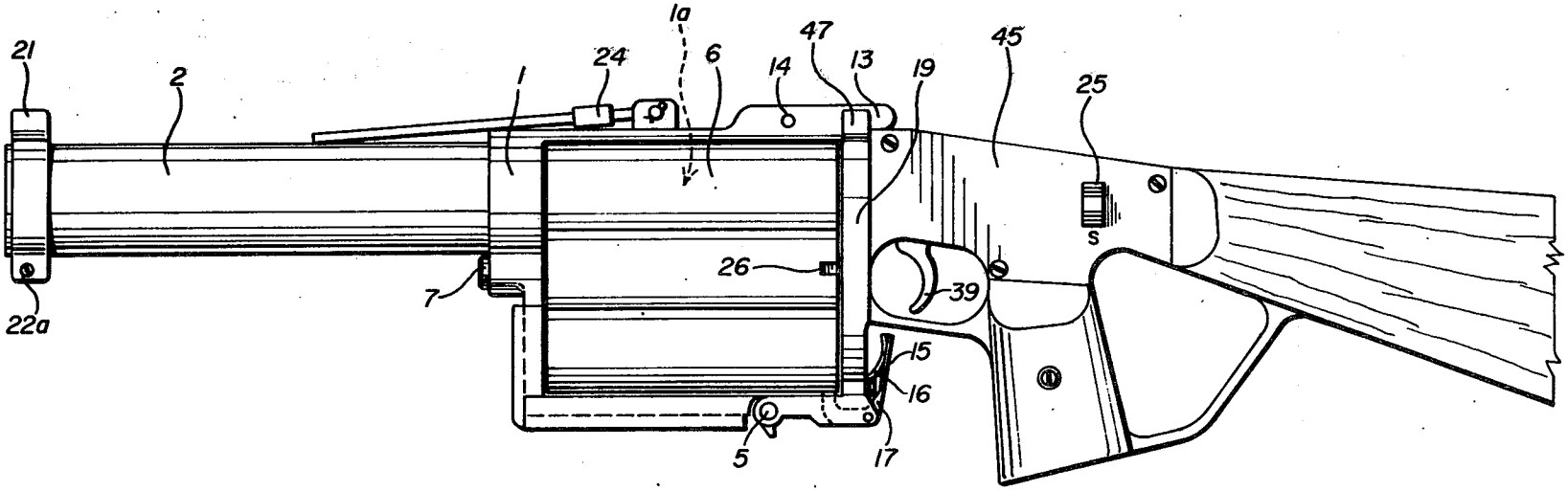
FIG. 1 is a schematic side elevation of the weapon according to the invention.
Figure 2:
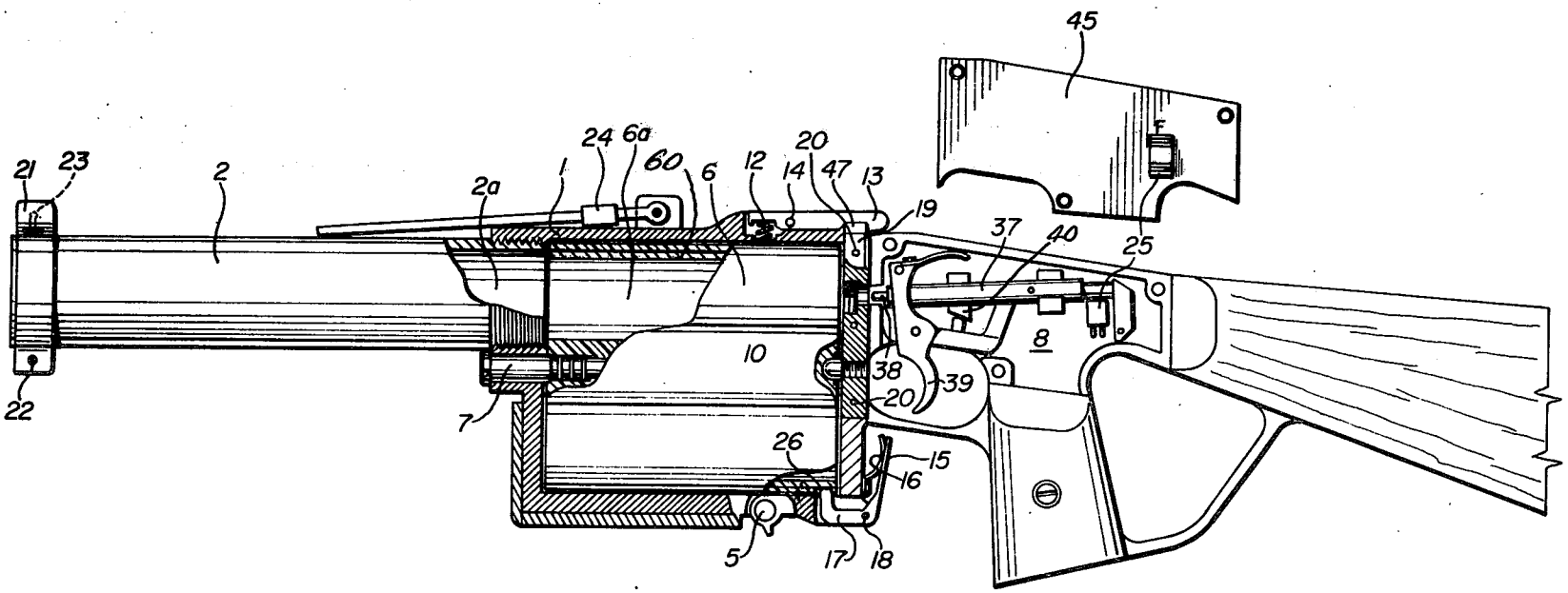
FIG. 2 is a side elevation, partly in section, illustrating the operating mechanism of the weapon according to the invention.
Figure 3:
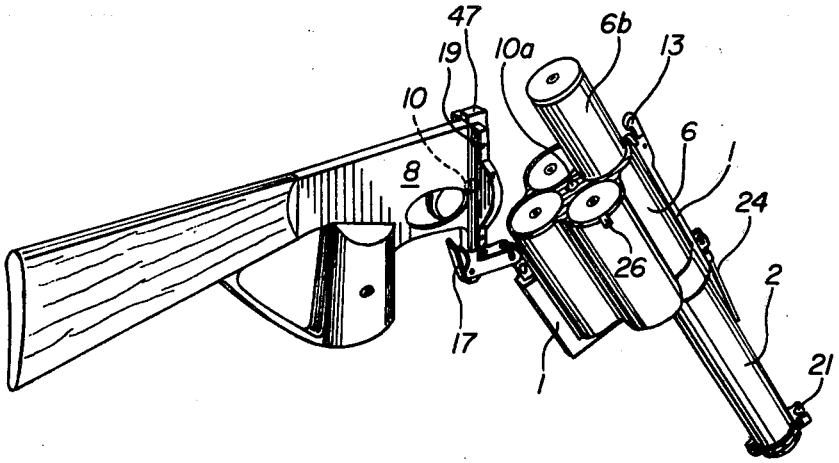
FIG. 3 is a perspective view of the weapon according to the invention, illustrating loading of the weapon.

Referring specifically to the drawings wherein like reference numerals represent like parts, the weapon is seen to comprise a barrel 2 including a bore 2*a*, threaded onto a breech frame 1. By threading the barrel 2 onto the breech frame 1, the clearance between the barrel 2 and the magazine 6 can be easily adjusted. This allows for the elimination of any excess clearance which may have occurred as a result of an accumulation of manufacturing tolerances.

The breech frame 1 defines a lateral opening la through opposite sides of the breech frame 1. The breech opening l*a* is adapted to receive a magazine 6 having a plurality of chambers 6*a*, conveniently four, to accomodate relatively large calibre projectiles 6*b* e.g. 38 mm and 40 mm. /

The magazine 6 is supported in the opening in the breech frame l*a* for rotation on an axis parallel to and spaced from the barrel 2, by an axle 7 upon which the magazine 6 is freely rotatable. The axel 7 is received by a central opening in the front end of the magazine 6. To ensure that the magazine 6 is kept centered, additional support is provided by a rounded stud 10 which fits into a centrally located mounted cavity 10*a* in the rear end of the magazine 6, when the weapon is closed.

The magazine 6 is conveniently molded from a suitable plastics material, for example, polycarbonate. Alternatively, it may be fabricated from a suitable metal such as aluminum.

The chambers 6*a* are uniformly spaced about the axis of rotation of the magazine 6 in such a manner that they may be successively brought into a firing position in alignment with the barrel 2 by manually rotating the magazine 6.

Positioning of the magazine 6 such that a chamber 6*a* is aligned with the barrel 2 is maintained by providing locking slots 26, one for each chamber 6*a*, in the magazine 6, for receiving a locking catch 17. The locking catch 17 is pivotally mounted on the stock and firing means 8 via pin 18 and is spring loaded by means of a piece of spring steel 16 also mounted on the stock and firing means 8. The locking catch 17 may be disengaged from a particular locking slot 26 by pressing down on a release lever 15 against the spring 16. When the lever 15 is released, the biasing action of the spring will force the locking catch back into the slot 26.

Figure 5:
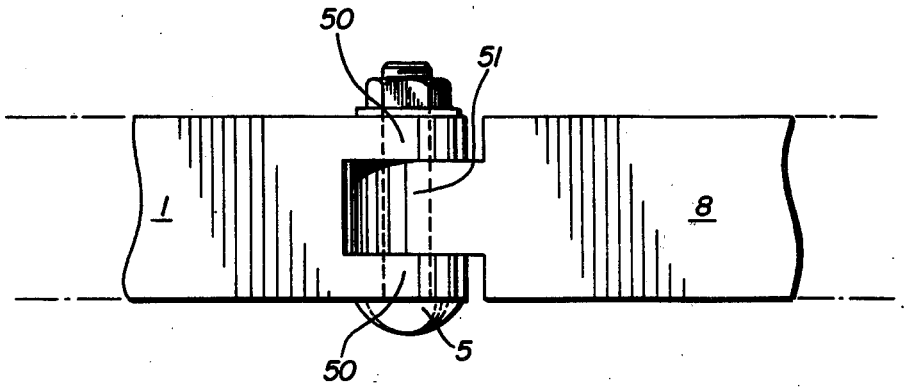
FIG. 5 is a bottom view of part of the weapon according to the invention, illustrating the pivoting action of the breech frame when the weapon is opened.
Figure 4A:
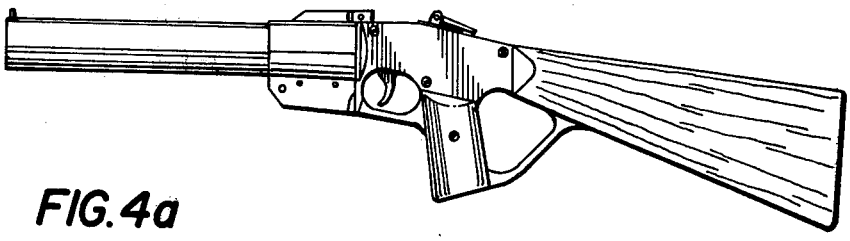
FIGS. 4*a* to 4*d* represent a series side elevations illustrating the conversion of an existing single-shot weapon to multi-shot capability.
Figure 4B:
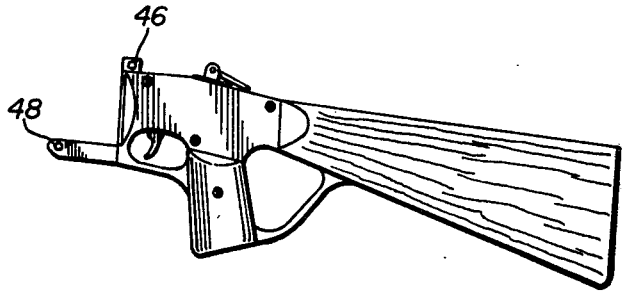
Figure 4C:
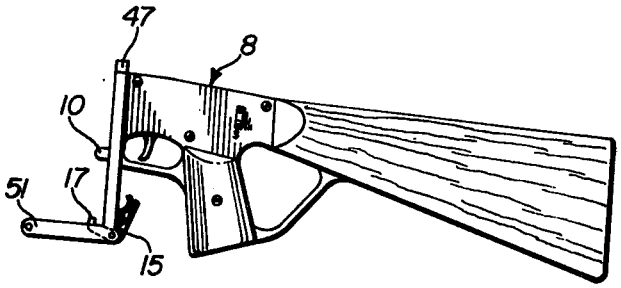
Figure 4D:
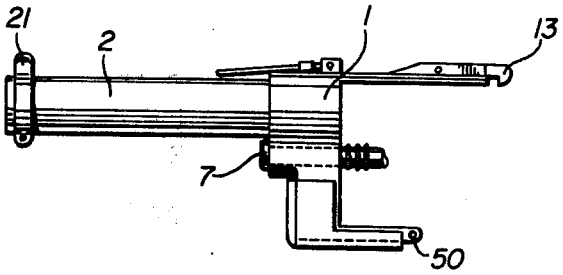

The breech frame 1 is pivotably connected to the stock and firing means 8 about a pivot pin 5. As best seen in FIG. 5, the breech frame includes a pair of spaced lugs son defining a channel for receiving a projection 51 on the modified stock and firing means 8. Holes are provided in the lugs 50 and the projection 51 to accommodate the pivot pin 5.

A conventional firing means is associated with the breech frame 1 for firing a projectile when in the firing position.

Specifically, the firing means comprises a spring-loaded striker rod 37 carrying a firing pin 38 which is pulled backwards under the action of a trigger 39. When the trigger 39 is pulled back a certain distance, the striker rod 37 is released forwardly under the action of a release cam 40 and the firing pin 38 is forced into the primer cap of a cartridge in the firing position, causing a projectile to be launched. Access to the firing means is afforded by means of a removable cover plate 45.

A safety catch 25 is provided which is slideable in a groove between an engaged position wherein the striker rod 37 is prevented from moving backwards when the trigger 39 is pulled; and a disengaged position wherein the striker rod 37 is free to move backwards under the action of the trigger 39.

A breech catch 13 is pivotably mounted on the breech frame 1 by means of a pin 14. A pair of spaced lugs 47 are provided on the stock and firing means 8 for engagement with the latch 13. A coil spring 12 is provided in a cavity in the breech frame 1 to minimize the chance of the latch 13 being dislodged accidentally. Thus, by moving the latch 13 upwards, the weapon may be opened.

A cover plate 19 is mounted on the breech frame by means of selftapping screws 20.

Rifled sleeves 60 may be inserted into the chambers 6*a*. The rifling allows the projectile to acquire spin smoothly at launch, thus avoiding damage to its engraving band. p A front sight 21 is attached to the barrel 2 by clamping action, such that if the weapon is dropped, the sight can turn around the barrel without damage. The sight 21 may then be re-aligned by loosening the clamp screw 22, positioning the sight 21 correctly, and then re-tightening the clamp screw 22. The front sight screw 23 is adjustable up or down to provide for adjustment of the sighting system.

A rear sight 24, mounted on the breech frame 1, conveniently of the folding leaf type with adjustment to be provided for range and drift.

According to another embodiment of the invention, existing single-shot weapons, for example, the 38 mm Federal Gas Gun, may be converted to multi-shot capability. More specifically, as seen in FIGS. 4*a* to 4*d*, 4*a* represents the 38 mm Federal Gas Gun, 4*b* illustrates the same gun with the barrel removed and discarded, 4*c* shows the same weapon having been modified by cutting away the existing latch lugs 46 and replacing them with spaced reinforced lugs 47, and re-locating pivot point 48 to enable connection with the conversion unit illustrated in 4*d*.

The conversion unit comprises a breech frame 1 adapted to receive a magazine 6, and including a barrel 2 mounted thereon, and means for connecting the conversion unit to said modified stock and firing means 8 at 47 and 51.

This feature should prove to be economically attractive to parties who already possess these single-shot weapons and wish to convert them to multi-shot capability.

The connecting means comprises a breech latch 13 and spaced lugs 50 mounted on the breech frame 1. Projection 51, on the modified stock and firing means 8 is located between the lugs 50 and a retaining pin 5 is inserted through the lugs such that the breech assembly is pivotally connected to the modified stock and firing means 8. The breech latch 13 engages with latch lugs 47 to rigidly connect the breech assembly to the modified stock and firing means 8.

By releasing the breech latch 13, the breech frame 1 can be broken open for single shot firing of rounds whose length is longer than that of the magazine 6. This is a feature not possessed, by most other multi-shot systems which are usually limited to rounds of one particular length.

On firing, the magazine 6 acts as a part of the barrel 2, eliminating the need for any reciprocating breech parts as is required in most other types of repeating guns for chambering and extracting the cartridge cases. In this respect, it is similar to a conventional revolver.

To load the weapon, the following operations are required: First, the safety catch 25 is moved to the engaged position.

The breech catch 13 is then released and the breech frame 1 is broken open. Cartridge cases are then removed by inverting the weapon and replaced by fresh ammunition. The breech is then closed and the magazine 6 turned until it is locked into position by the locking catch 17. The locking catch 17 is spring loaded and fits into slots 26 in the magazine 6 when a chamber 6*a* is aligned with the barrel 2. To turn the magazine, the release lever 15 must first be pressed which removes the locking catch 17 from the slot 26 in the magazine 6. The magazine may now be turned. While the magazine 6 is being turned the pressure is removed from the release lever 15 such that when the slot 26 corresponding to the next shot to be fired becomes aligned with the locking catch 17, the spring 16 forces the locking catch 17 into the slot 26 of the magazine 6 thus locking the magazine in place. When the safety catch 25 is moved to the disengaged position, the weapon is ready for firing.

After a shot has been fired, a fresh round is brought into the firing position as follows: The locking catch 17 is removed from the slot 26 in the magazine by depressing the release lever 15. The magazine 6 is then manually rotated using the thumb of the forehand. The thumb simply pushes tangentially on the outside surface of the magazine 6 to cause rotation about the axle 7. Once rotation of the magazine has begun, the fingers are removed from the release lever 15 such that, under action of the spring 12, the locking catch 17 engages the slot 26 in the magazine when the next shot to be fired becomes aligned with the barrel 2.

The weapon has proven to be compatible with existing 38 mm and 40 mm, combat, practice, and internal security ammunition. This includes both spin stabilized and non-spin stabilized projectiles.

Rapid conversion of the weapon from one calibre to another or from a rifled system to a smooth-bore system is easily performed in the field with no special tools being required. All that is required is to manually unscrew the barrel 2 and replace it and its corresponding magazine 6 with a barrel and magazine combination having the desired alternative characteristics.

In view of the various embodiments described hereinabove, it should be apparent to those skilled in the art that the present invention may be embodied in forms other than those specifically described herein without departing from the spirit or central characteristics of the invention. Thus, the specific embodiments described above are to be considered in all respects as illustrative and not restrictive.

What I claim is:

1. A conversion unit for use in converting a weapon of single-shot capability, to one of multiple shot capability, said single shot weapon having a barrel to be removed and discarded and a stock and firing means to be modified for use with said conversion unit, said conversion unit comprising a barrel, a breech frame on which the barrel is mounted, and means for connecting the conversion unit to said stock and firing means, said breech frame when connected to said modified stock and firing means defining a lateral opening through opposite sides of the frame for receiving a magazine having a plurality of chambers to accommodate relatively large calibre projectiles, said magazine being rotatably mounted in said opening and being adapted to be rotatably advanced in such a manner that the chambers are successively brought into a firing position in alignment with the barrel.

2. A conversion unit according to claim 1, wherein the magazine is adapted to be advanced manually.

3. A conversion unit according to claim 2, wherein the magazine includes a central axis of rotation upon which it is rotatable, said chambers being equally spaced about the axis of rotation and wherein said magazine is mounted on said breech frame upon said axis of rotation.

4. A conversion unit according to claim 3, wherein the magazine is constructed of a suitable plastics material.

5. A conversion unit according to claim 4, wherein the suitable plastics material is polycarbonate.

6. A conversion unit according to claim 5, wherein the barrel is threaded into the breech frame to allow for adjustment of the clearance between the barrel and the magazine.

7. A conversion unit according to claim 6 wherein the chambers are provided with rifled sleeves to allow the projectiles to acquire spin smoothly during launch.

8. A conversion unit according to claim 1, wherein the relatively high calibre projectiles are selected from 38 mm and 40 mm.

9. A conversion unit according to claim 3 including a springloaded locking catch, and a plurality of slots on the periphery of the magazine, said locking catch being biased against the magazine in such a manner that when the magazine is rotated to align a chamber with the barrel, the catch engages in one of said slots in the magazine to maintain said alignment; and when the next chamber is to be aligned with the barrel, the biasing is monentarily released to disengage the catch from the slot and the magazine rotated to align the next chamber with the barrel.

* * * * *